US011118401B2

(12) United States Patent
Aising Lopez

(10) Patent No.: US 11,118,401 B2
(45) Date of Patent: Sep. 14, 2021

(54) BACKHEAD ASSEMBLY FOR DTH HAMMER

(71) Applicant: DRILLCO TOOLS S.A., Santiago (CL)

(72) Inventor: Jorge Alejandro Aising Lopez, Santiago (CL)

(73) Assignee: DRILLCO TOOLS S.A., Santiago (CL)

( * ) Notice: Subject to any disclaimer, the term of this patent is extended or adjusted under 35 U.S.C. 154(b) by 56 days.

(21) Appl. No.: 16/608,088

(22) PCT Filed: Apr. 23, 2018

(86) PCT No.: PCT/IB2018/052814
§ 371 (c)(1),
(2) Date: Oct. 24, 2019

(87) PCT Pub. No.: WO2018/198017
PCT Pub. Date: Nov. 1, 2018

(65) Prior Publication Data

US 2020/0256127 A1 Aug. 13, 2020

(30) Foreign Application Priority Data

Apr. 25, 2017 (CL) ..... 1018-2017

(51) Int. Cl.
*E21B 4/14* (2006.01)

(52) U.S. Cl.
CPC ..... *E21B 4/14* (2013.01)

(58) Field of Classification Search
CPC ..... E21B 4/14
See application file for complete search history.

(56) References Cited

U.S. PATENT DOCUMENTS

2005/0034899 A1* 2/2005 Lyon ..... E21B 4/14 175/296
2010/0012380 A1* 1/2010 Swadi ..... E21B 34/14 175/57
2013/0233626 A1* 9/2013 Aros ..... E21B 4/14 175/296

* cited by examiner

*Primary Examiner* — Giovanna Wright
(74) *Attorney, Agent, or Firm* — Womble Bond Dickinson (US) LLP

(57) ABSTRACT

A backhead assembly system for a Down The Hole (DTH) hammer operated by a supply of compressed fluid, that comprises mainly a backhead, said backhead having a central hole capable of transporting the pressurized air to the hammer and an inner cylinder, coaxially disposed and coupled with releasable holding mediums to the backhead, were said backhead has an interior frontal cavity and said releasable holding mediums are in the mentioned frontal cavity. The hammer also comprises a wear sleeve, coaxially disposed to the backhead and inner cylinder, in which the backhead is coupled to the rear side of the wear sleeve. In both embodiments of the present invention, the inner sleeve has a rear section of less diameter and a front side of larger diameter; both sections joined through a portion of generally increasing diameter.

12 Claims, 3 Drawing Sheets

BACKHEAD ASSEMBLY FOR DTH HAMMER

FIELD OF THE INVENTION

The present invention is related to drilling apparatus, moreover, it is related to DTH hammers with an inner sleeve and the grappling of said inner sleeve.

BACKGROUND OF THE INVENTION

Percussion hammers, DTH hammers in particular, generally operate with a pressurized fluid flow, using this fluid to either fill or empty different inner chambers which are in contact with the piston, generating an alternating movement of the piston, which allows the piston to strike repeatedly a bit that is at the same time in contact with the rock, provoking the breakage of the rock.

These kinds of hammers are usually composed of a cylindrical casing, i.e. wear sleeve, that works as a housing to the other components; a drill bit support ("chuck"), a backhead in the rear side, a bit coaxially disposed to the drill bit support and allowed to slide inside of it; a piston sliding and coaxially disposed inside the wear sleeve and other elements used to hold or align parts and direct the pressurized flow within the hammer.

There are several types of hammers according to its air distributing mechanism; there is a first type of hammer that uses a feeding tube to canalize the flow into the piston's interior, to then distribute the air to the chambers through holes in the piston. This kind of hammer has the issue that the piston is structurally weak because of said holes, which under impact work as a stress concentrator in the piston. Moreover, there are frequent problems with the manufacturing process of deburring and surface finishing of said holes, due to the difficulty of accessing specific surface areas, especially on the piston's interior.

A second type of hammers is one that uses an inner cylinder coaxially disposed into the wear sleeve, an element that allows the channeling of the fluid flow from the source into the intermedium chamber, external to the piston, and that with the reciprocating movement of the piston can distribute the fluid to other chambers of the hammer. This inner cylinder commonly comprises a medium-rear section of the hammer and allows a rear part of the piston to slide into the interior of it.

The invention described in this patent is related to this second type of hammer, therefore uses an inner cylinder to channelize the air into an intermedium chamber at the exterior of the piston.

The inner cylinder can be held in different ways inside the wear sleeve. One mechanism for fastening said inner sleeve is the provision of a support shoulder in the interior of the wear sleeve. The issue with this method is that the useful transversal section is reduced due to said shoulder, i.e., the shoulder reduces the thrust area of the compressed fluid to the piston, therefore reducing the power of the hammer. There are different existing solutions to decrease the loss of the transversal section. One of them is presented in U.S. Pat. No. 6,290,424, in which a split ring is used to hang the inner cylinder from the wear sleeve, resulting in the split ring being expanded between a shoulder of the inner cylinder and a recess in the wear sleeve.

Another solution is presented in U.S. Pat. No. 7,159,676 where the inner cylinder has at the rear section a series of longitudinal grooves that allow the radial deflection of the inner cylinder and to hook a rear shoulder of the inner cylinder to a recess of the wear sleeve. Ultimately, there is a third solution, presented in U.S. Pat. No. 6,637,520 where the inner cylinder has several longitudinal grooves at the rear section that allow it to expand when a conical part is inserted in it. This way, the outside shoulder is attached to a wear sleeve inner recess.

To a greater or lesser extent, all the fastening systems described in the aforementioned patents require a recess in the wear sleeve that reduces the useful transversal section, which results in a reduced thrust area on the piston or a reduced thickness of the wear sleeve; resulting in a decrease of the hammer's useful life. All these fastening systems require a part that compresses the set to avoid wear of the support shoulder of the inner cylinder.

There is another invention that achieves the required solution to the mentioned problems, but to manufacture said solution is expensive and complicated. U.S. Pat. Nos. 8,006,784 and 6,386,301 explain assemblies in which the backhead is affixed to the inner cylinder, as one single part. To manufacture this part, it is necessary to begin with a long and massive piece of metal. Therefore, not only is it complicated in relation to the machine process and manufacture, but there is also a considerable amount of material loss and inefficiency in doing so.

The present invention solves this fastening problem without generating recesses in the wear sleeve and thereby uses the rear transversal section of the hammer more efficiently resulting in an increase of the power of the hammer. Additionally, this design does not require an element to keep the assembly compressed. The invention implies a structure of a rear subassembly, which, when uncoupling the backhead, enables a direct removal of the piston, therefore simplifying any maintenance work on the hammer. By keeping the parts individual and independent, it is not difficult nor expensive to manufacture. Finally, having the inner cylinder fastened to the backhead and not to the wear sleeve allows shortening the length of the hammer, decreasing raw material costs and making the assembled system lighter and easier to manipulate.

SUMMARY OF THE INVENTION

In the present invention a backhead assembly has been developed for a DTH hammer, which consists mainly of an inner cylinder coaxially disposed inside a cylindrical casing, i.e. the wear sleeve, a backhead coupled at the rear end of the wear sleeve, said backhead having an interior frontal cavity and a central hole to transport a compressed fluid from the supply to the hammer, were said inner cylinder is coupled through releasable means to said backhead frontal cavity. In a first embodiment of the invention, said inner cylinder has a rear cylindrical section, a frontal section of lesser diameter than the latter, and a generally increasing connection joining said sections.

The previously described shape allows it to couple, through its lesser diameter section, to the interior of the backhead and receive a piston in its larger diameter section.

According to a first embodiment of the present invention, to achieve the releasable fastening of the inner cylinder, said cylinder has in its rear portion two or more grooves in the axial direction, forming a series of fins, where each one can be deflected radially. Each one of these fins has ledges on its exterior surface that describe a circumference around the perimeter of the inner cylinder. The ledges are axially separated, and contained in parallel planes.

Additionally, a set of ports is provided, having a completely or partially inclined outlet allowing the connection of the pressurized fluid flow to the annular space between the inner cylinder and the wear sleeve.

The ledges can either be all of the same height or decrease in height while the ledge is closer to the pivot point of the fin, being the latter option the preferred one. For this option, while setting the inner cylinder in its position, i.e., inserting the fins into the backhead, the deflection of each fin does not increase. Once achieving the required axial depth, the ledges fasten to the similar grooves embedded inside the interior of the backhead. Alternative fasten modes are derived from this system.

To avoid unwanted loosening of the inner cylinder by an inward deflection of the fins, a cylindrical or conical part adjusts to the inner surface of the inner cylinder up to the level of the fins. It is preferred that this part be an air guide, which is the element located at the upper section of the inner cylinder, and in its frontal section, possesses a cylindrical shape that fits in the rear interior section of an axially bored piston, coaxially disposed to the wear sleeve and inner cylinder. Nevertheless, a separate part could be designed just for this purpose. In the present configuration, the part gets fixed to the backhead through a pin. However, any other way of fixing the assembly could be used.

In a second embodiment of the invention, the inner cylinder is fastened to the backhead with a pin, the latter being the releasing mechanism. Thereby a rear subassembly is created, comprising mainly a backhead and an inner sleeve. Said subassembly is possible because in this second embodiment, said inner cylinder comprises a rear section of lesser diameter than that of the frontal interior cavity of the backhead, while the front section is of a larger diameter, to house a piston.

Fastening the inner cylinder to the interior of the backhead allows the efficient use of the interior area of the wear sleeve since there are no area losses due to a shoulder embedded in the wear sleeve supporting the inner cylinder. This new design feature is desirable in a hammer due to that it increases the active thrust area in the piston, and therefore applies an increased force to the piston stroke, thus increasing the hammer power.

Furthermore, by incorporating the rear section of the inner cylinder inside the backhead and not below it, as it has been ubiquitously applied in the DTH hammer market, a shorter hammer is achievable. The latter allows decreasing the manufacturing costs and raw material requirement in the manufacturing process. In the same way, by having less material, it allows the hammer to be lighter and easier to handle, which is ideal for operation and maintenance tasks.

Another advantage of the present invention is having an inner cylinder that can hold onto the backhead and not to the wear sleeve, allowing to create a rear sub-assembly, which consists mainly of a backhead, an inner cylinder and fastening means. Said sub-assembly enables disassembling the hammer from the rear, giving direct access to the piston, a feature widely desired in the maintenance due to that it eases the inspection and removal of the piston.

BRIEF DESCRIPTION OF THE DRAWINGS

FIG. 1-B is a sectioned view of a second embodiment.

DETAILED DESCRIPTION OF EXEMPLARY EMBODIMENTS

Figure 1A:
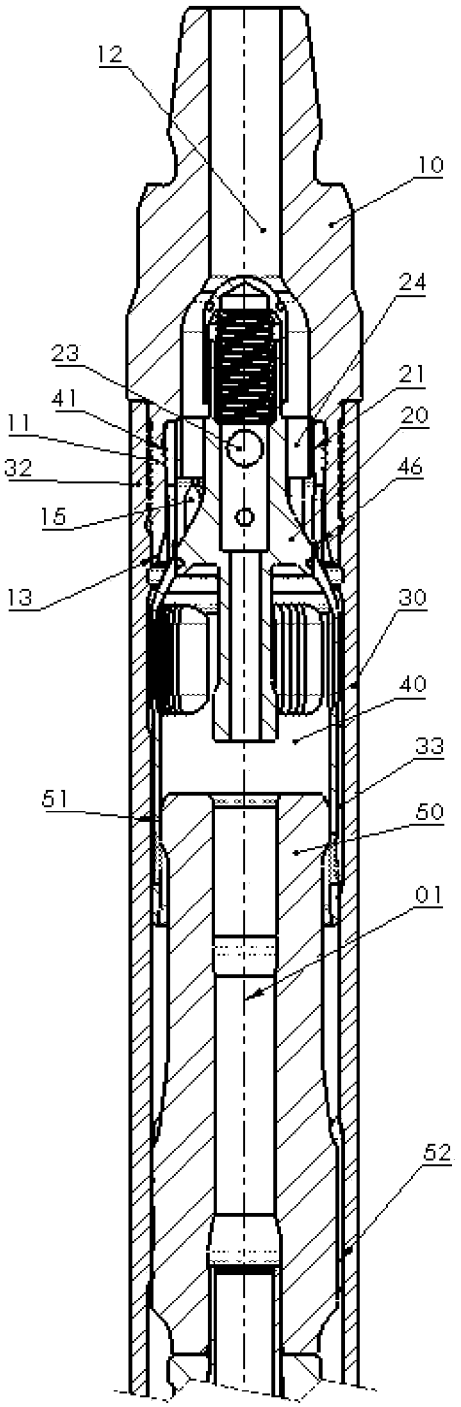
FIG. 1-A is a sectioned view of the rear side hammer assembly of a first embodiment. In this view, a backhead, wear sleeve, fastened means, inner cylinder and piston are presented.
Figure 1B:
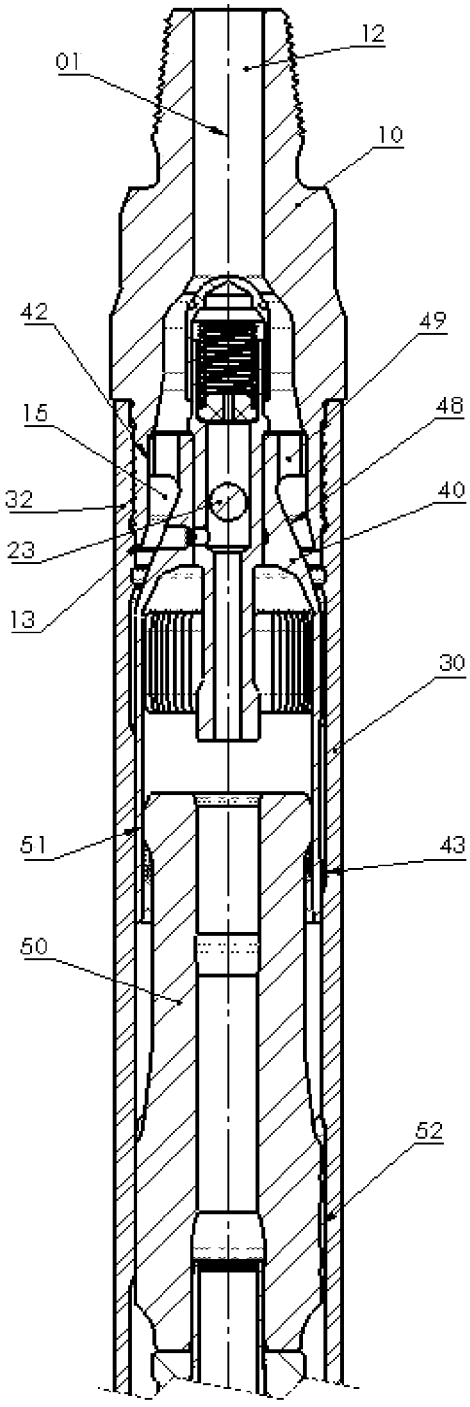

FIG. 1-A is a DTH hammer section according to a first embodiment, conformed by a cylindrical casing or wear sleeve (30), a central bored (12) backhead (10), and a frontal interior cavity (15) connected to said central bore (12). Said backhead is coaxially coupled to the cylindrical casing or wear sleeve (30) posterior side (32), and an inner cylinder (40) is coaxially disposed in the interior of said wear sleeve (30), generating an annular fluid path (33) between said inner cylinder (40) and said wear sleeve (30). The inner cylinder (40) has fins (47) and ledges (41) in the rear side and said backhead (10) has inner grooves (11) in the interior frontal cavity (15), where said inner cylinder (40) can be fixed to said backhead (10), deflecting said inner cylinder (40) fins (47) and matching said ledges (41) to the inner grooves (11) of the backhead (10). Said inner cylinder (40) can be released from the backhead (10) deflecting said fins (47) of the inner cylinder (40) and pulling the inner cylinder out of the backhead (10).

In the first embodiment, a retainer element (20) is provided, located in the interior of the inner cylinder (40) to avoid the accidental inward deflection of the same; a pin (23) is provided to maintain the retainer element (20) and is at the same time fixed to the backhead (10).

Inside the wear sleeve (30), there is a piston (50) that moves alternately along the axial axis (01) when the hammer is fed with pressurized fluid. The piston's (50) rear section (51) is inserted in the inner cylinder (40), while the frontal section (52) is in contact with the wear sleeve (30).

To make the pressurized fluid flow move the piston (50), it is first necessary to channel the flow to the annular channel (33) formed between the wear sleeve (30) and the inner cylinder (40), to then distribute the flow alternative to the rear section (51) and to the front section (52) of the piston.

For that reason the inner cylinder has ports (45) in its rear section, connecting the interior of the inner cylinder (40) to the annular channel (33), while the retainer element (20) has holes (24), that in conjunction with the inner cylinder port (45) allows the flow path from the central bore (12) of the backhead (10) to the annular channel (33).

Figure 2:
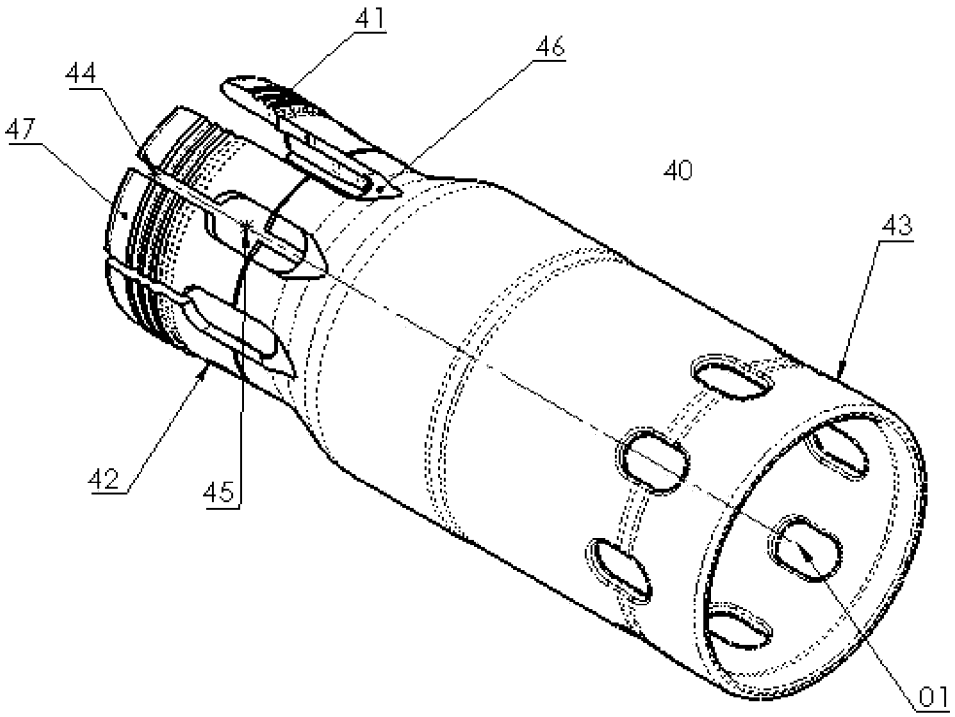
FIG. 2 is an isometric view of the inner cylinder defined in the first embodiment.

FIG. 2 shows an inner cylinder (40) that has in the posterior section (42) several longitudinal grooves (44) that generate fins (47). Next to the grooves (44), following the axial direction (01) and towards the frontal section (43) there are ports (45) ending in a total or partially inclined exit (46). In the outside surface of the fins (47) there are the ledges (41) that work as a fastening medium in this embodiment.

Figure 3:
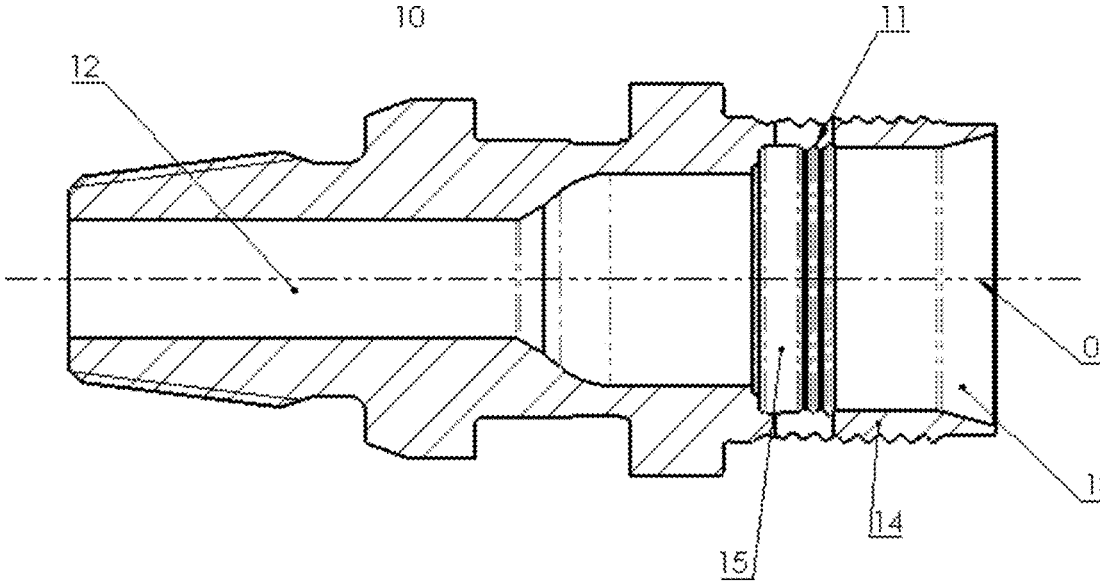
FIG. 3 is a backhead sectioned view, where it is possible to observe the grooves profile of the backhead interior for the first embodiment.

FIG. 3 shows a section of the backhead (10), with its central bore (12) that continues in its internal frontal section (14) until a bigger diameter cavity (15). In the interior of this cavity (15), there is a groove profile (11) that allows the releasing coupling mechanism with the ledges (41) of the inner cylinder. Also, a profile (13) that connects the pressurized fluid path to the annular section (33) between the inner cylinder (40) and the cylindrical casing (30) is seen.

Figure 4:
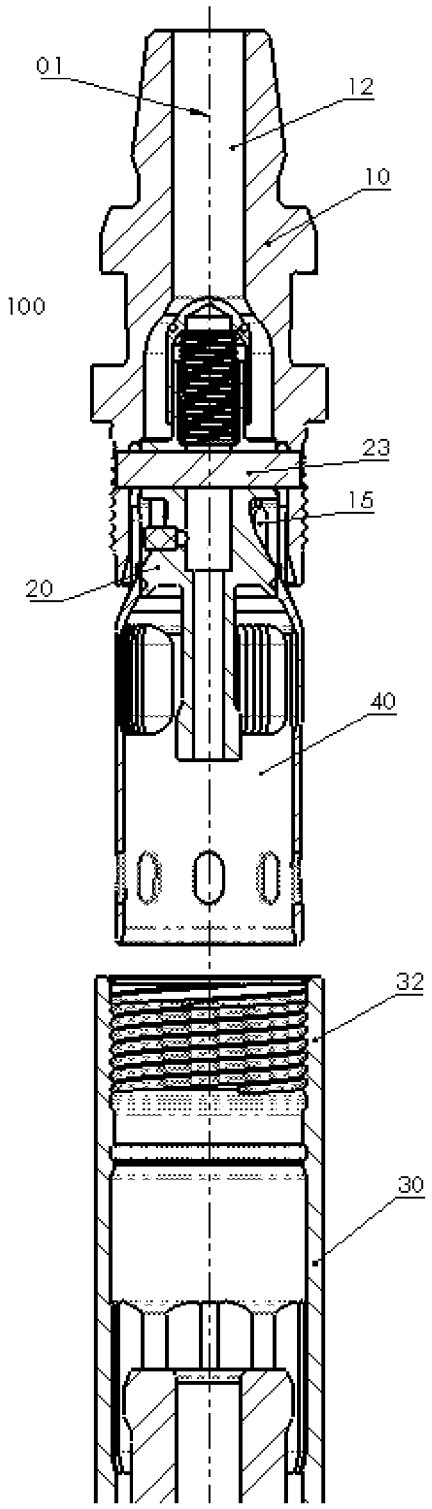
FIG. 4 is a sectioned view of the rear side hammer assembly, in which the upper subassembly of the first embodiment is removed from the hammer.

FIG. 4 shows a rear sub-assembly of the first embodiment, which is conformed mainly of the backhead (10), the inner cylinder (40), the retainer element (20) and the pin (23).

FIG. 1-B shows a DTH hammer section, according to a second embodiment, which is conformed by a cylindrical casing (30), also called wear sleeve, and in its rear side (32) is located a backhead (10). On said backhead, there is an inner cylinder (40), concentric to the wear sleeve (30) and the backhead (10); which is fixed to the latter by releasable fastenings means. In this embodiment, the fixture is done by a pin (23), resulting in a backhead sub-assembly, composed mainly by a backhead (10), an inner cylinder (40) and a pin (23)

In this second embodiment, to guide the pressurized fluid flow to the annular section between the inner cylinder and the wear sleeve, the inner cylinder (40) has orifices or ports (49) in its posterior section (42) that allow the flow to go through it defining a passage that starts at the central bore (12) of the backhead (10) continuing to the frontal interior cavity (15) of the backhead (10), passing through the orifices (49) of the inner cylinder (40), to then be guided by an external surface (48) of the increasing diameter section of the inner cylinder and the backhead profile (13).

The invention claimed is:

1. A Down-the-Hole hammer, comprising:

a cylindrical casing having a rear and front side;

an axial axis, longitudinal to the Down-the-Hole hammer and cylindrical casing;

a backhead coupled to the rear side of said casing, said backhead having a frontal interior cavity and a central bore to transport a compressed fluid flow from a supply to the Down-the-Hole hammer, an inner cylinder coaxially disposed inside said casing, said inner cylinder having a front and a rear side of different diameters, fastening means that allow a releasable coupling of the rear side of the inner cylinder to the frontal interior cavity of the backhead;

a piston co-axially disposed inside the cylindrical casing, where the rear side of said piston is disposed at an interior of the inner cylinder, the piston capable of reciprocating slidable movement;

wherein the fastening means includes:

a plurality of longitudinal grooves in a rear portion of the inner cylinder;

a plurality of fins, formed between the longitudinal grooves of the inner cylinder, one or more ledges in the rear portion of the inner cylinder, one or more grooves in the frontal interior cavity of the backhead, where the one or more ledges of the inner cylinder can fit into the one or more grooves of the backhead when the fins are being deflected; and radial retention means to avoid an inward deflection of the fins of the inner cylinder.

2. The Down-the-Hole hammer as claimed in claim 1, wherein:

the backhead with the inner cylinder and the fastening means form a subassembly that can be removed from the Down-the-Hole hammer as a whole, allowing direct access to the piston.

3. The Down-the-Hole hammer as claimed in claim 1, wherein the inner cylinder has a rear section of less diameter than a frontal section, and a variable diameter section that joins previous sections, this way the rear section of less diameter can be inserted into the frontal interior cavity of the backhead.

4. The Down-the-Hole hammer as claimed in claim 3 wherein the inner cylinder is fastened to the backhead through releasable fastening means.

5. The Down-the-Hole hammer as claimed in claim 1, wherein the one or more ledges of the inner cylinder form a conical profile, wherein the one or more ledges increase in height from the front to the rear side, being shorter at the front ledge and taller at the rear ledge.

6. The Down-the-Hole hammer as claimed in claim 1, wherein the inner cylinder has a rear section of less diameter than a frontal section, and a variable diameter section that joins previous sections together.

7. The Down-the-Hole hammer as claimed in claim 6, wherein the inner cylinder ports have a total or partially tilted exit.

8. The Down-the-Hole hammer as claimed in claim 1, wherein the inner cylinder has ports on a frontal side of the one or more grooves to allow the compressed fluid flow.

9. The Down-the-Hole hammer as claimed in claim 1, wherein the radial retention means consist of a part which contains an opening or channel capable of letting the air flow through the opening, where this part is held to the backhead through a pin.

10. The Down-the-Hole hammer as claimed in claim 1, wherein the backhead, inner cylinder, fastening means and radial retention means form a subassembly that can be removed from the Down-the-Hole hammer, allowing direct access to the piston.

11. The Down-the-Hole hammer as claimed in claim 1, wherein the inner cylinder is releasably fastened to the backhead through a pin.

12. The Down-the-Hole hammer as claimed in claim 1, wherein the radial retention means includes a part located inside the rear portion of the inner cylinder.

* * * * *